US005617069A

United States Patent [19]

Arikawa et al.

[11] Patent Number: 5,617,069

[45] Date of Patent: Apr. 1, 1997

[54] MICROCHIP FUSE WITH A CASING CONSTRUCTED FROM UPPER AND LOWER MEMBERS AND A HOLLOW PORTION IN THE CASING

[75] Inventors: Hiroo Arikawa, Tokyo; Akihiko Kanehara, Kanagawa-ken; Manabu Furusawa, Kanagawa-ken; Koh Ishimura, Kanagawa-ken, all of Japan

[73] Assignee: Soc Corporation, Tokyo, Japan

[21] Appl. No.: 466,977

[22] Filed: Jun. 6, 1995

[30] Foreign Application Priority Data

Oct. 3, 1994 [JP] Japan ..... 6-239027

[51] Int. Cl.[6] ..... H01H 85/143; H01H 85/165

[52] U.S. Cl. ..... 337/227; 337/249

[58] Field of Search ..... 337/227, 231, 337/260, 297, 186, 249, 250

[56] References Cited

U.S. PATENT DOCUMENTS

| | | | |
|---|---|---|---|
| 4,135,175 | 1/1979 | Perreault . | |
| 4,920,327 | 4/1990 | Arikawa . | |
| 5,363,082 | 11/1994 | Gurvich | 337/227 |

FOREIGN PATENT DOCUMENTS

| | | |
|---|---|---|
| 450343 | 7/1925 | Germany . |
| 721967 | 5/1942 | Germany . |
| 3051177 | 3/1981 | Germany . |
| 8608325 | 9/1987 | Germany . |
| 3833329A1 | 4/1989 | Germany . |
| 9407550 | 10/1994 | Germany . |

*Primary Examiner*—Leo P. Picard
*Assistant Examiner*—Jayprakash N. Gandhi
*Attorney, Agent, or Firm*—Wenderoth, Lind & Ponack

[57] ABSTRACT

A microchip fuse is disclosed which includes a casing constructed from box-like upper and lower members. On the end surfaces of both members, electrode sections are provided which are formed by plating metal onto a sintered conductive paste on the end surfaces. Grooves are provided on the members and filled with insulating material. A fusible element extends through the insulating material and the inner surface as formed when the both members are jointed together. The end portions of the fusible element are soldered to the electrode sections. A hollow portion is provided in the casing adjacent to the inner space by way of a thin wall to dampen the pressure of a gas generated during the interruption process.

7 Claims, 4 Drawing Sheets

MICROCHIP FUSE WITH A CASING CONSTRUCTED FROM UPPER AND LOWER MEMBERS AND A HOLLOW PORTION IN THE CASING

BACKGROUND OF THE INVENTION

1. Field of the Invention

The present invention relates to a microchip fuse suitable for surface mounting on a printed board or the like.

2. Description of Prior Art

A microchip fuse according to the prior art comprises a cylindrical casing, an elongated fusible element extending through a hollow portion between the opposite ends of the casing, and cap-shaped conductive terminals fitted to the opposite ends of the casing and electrically connected to the ends of the fusible element (for example, refer to U.S. Pat. No. 4,920,327).

A fuse is restricted in terms of the distance between the tip ends of the opposite conductive terminals, that is, the creepage distance must be kept at a required length depending on the required electric characteristics in order to attain desired electric characteristics. According to the microchip fuse of such prior art as above, since the circumferential portions of the cap-shaped conductive terminals are fitted to the casing in such a manner as to cover the side surface of the casing, the distance between the tip ends of the conductive terminals will be shorter than the distance between the opposite end surfaces of the casing by an amount equal to twice the width of the circumferential portions of the conductive terminals. As a consequence, the total length of the fuse in the direction of the conductive terminals has been limited to approximately 6 mm due to the limitation imposed by the creepage distance mentioned above.

On the other hand, there have been frequently used electrodes having a metallic sheet in an L-shape and attached to the opposite end surfaces and their adjacent circumferential surface of a cylindrical casing. However, as the portions of the metallic sheet extend over the side surfaces of the casing, there has also been a limitation regarding shortening the length of the fuse between the electrodes for the same reason as the cap-shaped conductive terminals as explained above.

Notwithstanding the above-mentioned limitations, since miniaturization of electronic appliances proceeds increasingly in the recent years, there have been demands made for miniaturization of electronic components. Besides, demands for quick acting microchip fuses are also so considerable that for this purpose it has become necessary to further shorten the length of the fusible element. There are now required fuses wherein the total length of the fuse between the electrodes is shorter than 6 mm. In fact, lengths in the order of 1.5 mm are desired. For a microchip fuse satisfying such a requirement since a conductive terminal construction and metallic sheet electrodes according to the prior art require the width of the circumferential portion to be in the order of 0.5–1 mm, they are unsuitable for use in highly miniaturized fuses.

It is conceivable to construct a thin electrode by applying metallic vapor deposition or the like to the opposite end surfaces of a casing. However, metallic vapor deposition requires a vacuum apparatus, resulting in expensive facilities and targets. Furthermore, production efficiency is not good, due to batch-wise production, and production costs increase. Consequently, this method is not actually applied.

As explained above, the casing for the microchip fuse according to a prior art is cylindrical in many cases. The sectional dimension of the microchip fuse having a total length of about 6 mm is normally in the order of 2–3 mm, so that it is not easy from the production point of view to extend such a very thin fusible element having a size of about some ten μm between the opposite end surfaces of the casing through a small cylindrical hollow portion.

SUMMARY OF THE INVENTION

An object of the present invention is to provide a miniaturized microchip fuse which is suitable for mass production, by overcoming the above-mentioned problems.

Another object of the present invention is to provide such a microchip fuse which is hard to be destroyed by the pressure of the Gas Generated during the interruption process.

A further object of the present invention is to provide a microchip fuse which is quite miniaturized while keeping the insulation characteristics of a conventional microchip fuse.

To achieve these objects, a microchip fuse according to the present invention comprises an upper member including a pair of upper end surface members oppositely disposed with a given space therebetween, a pair of upper side members for connecting the opposite side portions of the pair of upper end surface members and an upper lid member for covering the upper edge portions of the pair of upper end surface members and the pair of upper side members. The upper member is made of an electrically insulating material. A lower member includes a pair of lower end surface members oppositely disposed with a given space therebetween, a pair of lower side members for connecting the opposite side portions of the pair of lower end surface members and a lower lid member for covering the lower edge portions of the pair of lower end surface members and the lower side members. The lower member is made of an electrically insulating material. Electrode sections are provided at the outer end surfaces of the pair of upper end surface members of the upper member and the pair of lower end surface members of the lower member by sintering to adhere electrically conductive paste thereto. The lower edge portions of the upper end surface members and the upper edge portions of the lower end surface members as well as the lower edge portions of the upper side members and the upper edge portions of the lower side members are so jointed that the end surface portions of both of the end surface members form one planar surface and define an enclosed space in the upper member and the lower member. The microchip fuse further comprises a wire-like fusible element sandwiched between the lower edge portions of the upper end surface members and the upper edge portions of the lower end surface members and extending through the enclosed space. The respective end portions of the fusible element are electrically connected to the electrode sections.

The conductive paste is applied to and sintered at the respective outer end surface of the upper end surface member of the upper member and the lower end surface member of the lower member, so that the electrode section is adhered to and formed at the outer end surfaces. Since the sintering process may be executed in atmospheric conditions, the microchip fuse according to the present invention can be produced at a lower cost. Furthermore, since the electrode sections are located only at the opposite end surfaces of the casing, not at the side surfaces thereof, a maximum creepage distance between the opposite electrode sections may be obtained, such that the fuse can be further miniaturized as compared to the conventional ones for the same required creepage distance. Such further miniaturization allows the length of the fusible element to be made shorter, whereby more quick acting characteristics can be realized than in the prior arts.

Employment of the mating type construction of the casing comprising the upper member and the lower member makes it easy to extend the fusible element and realize an economical mass production.

BRIEF DESCRIPTION OF THE DRAWINGS

The above and other objects and features of the invention will become more obvious hereinafter from a consideration of the following description taken in connection with the accompanying drawings, wherein.

DESCRIPTION OF THE PREFERRED EMBODIMENTS

Some preferred embodiments of the present invention will now be explained by referring to the accompanying drawings.

Figure 1:
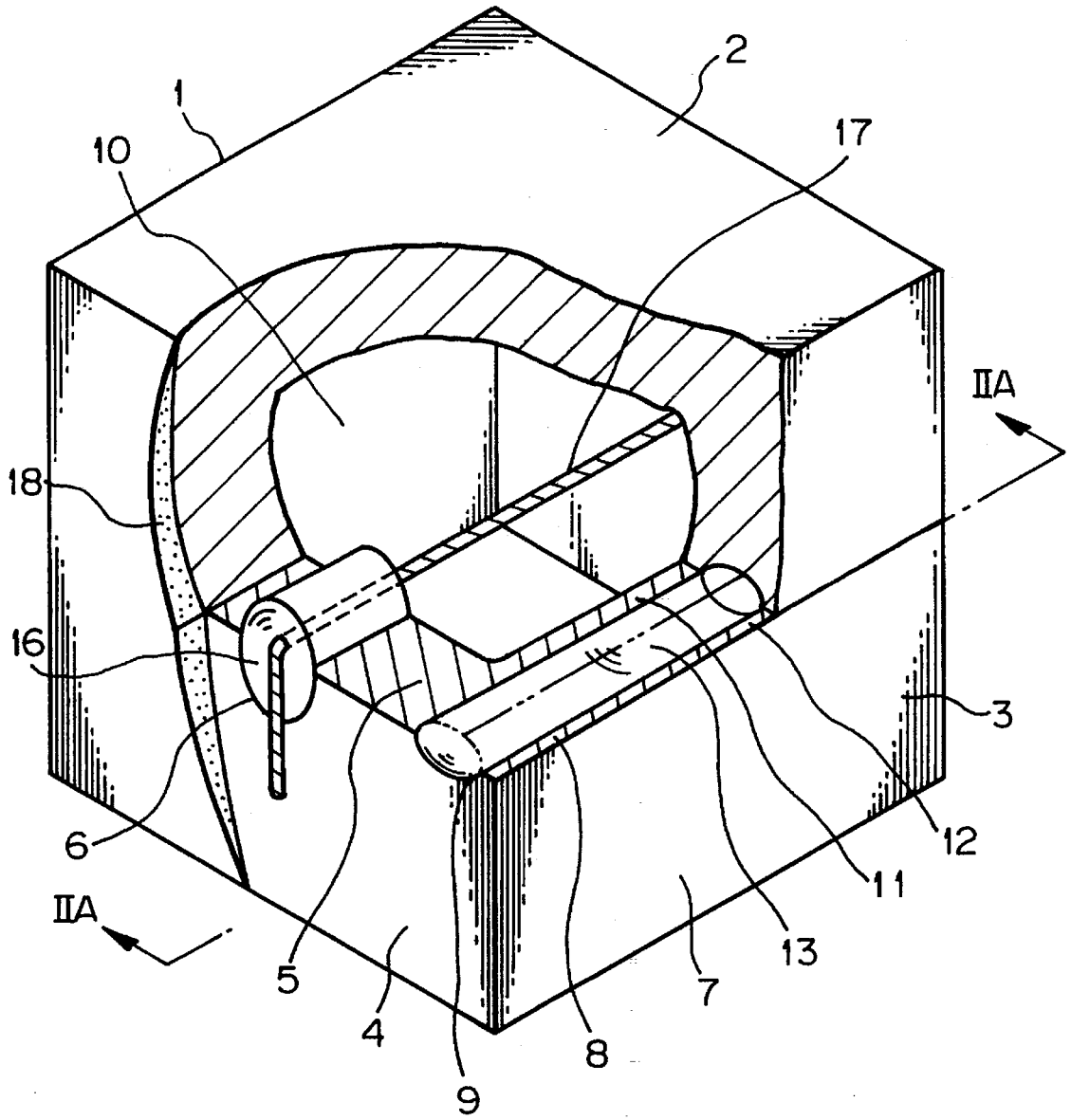
FIG. 1 is a partly broken perspective view showing a microchip fuse which is an embodiment of the present invention.
Figure 2B:
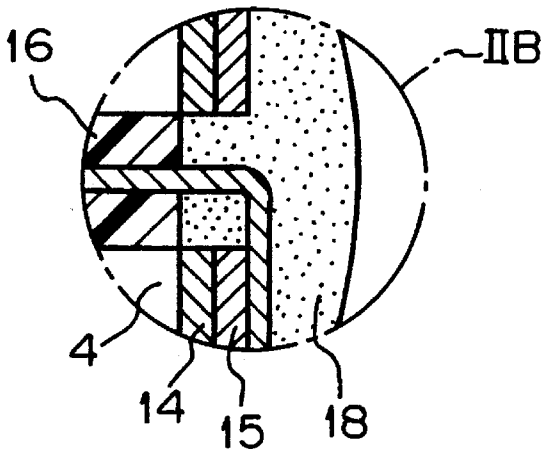
FIG. 2B is an enlarged view of the part designated by IIB in FIG. 2A.
Figure 2A:
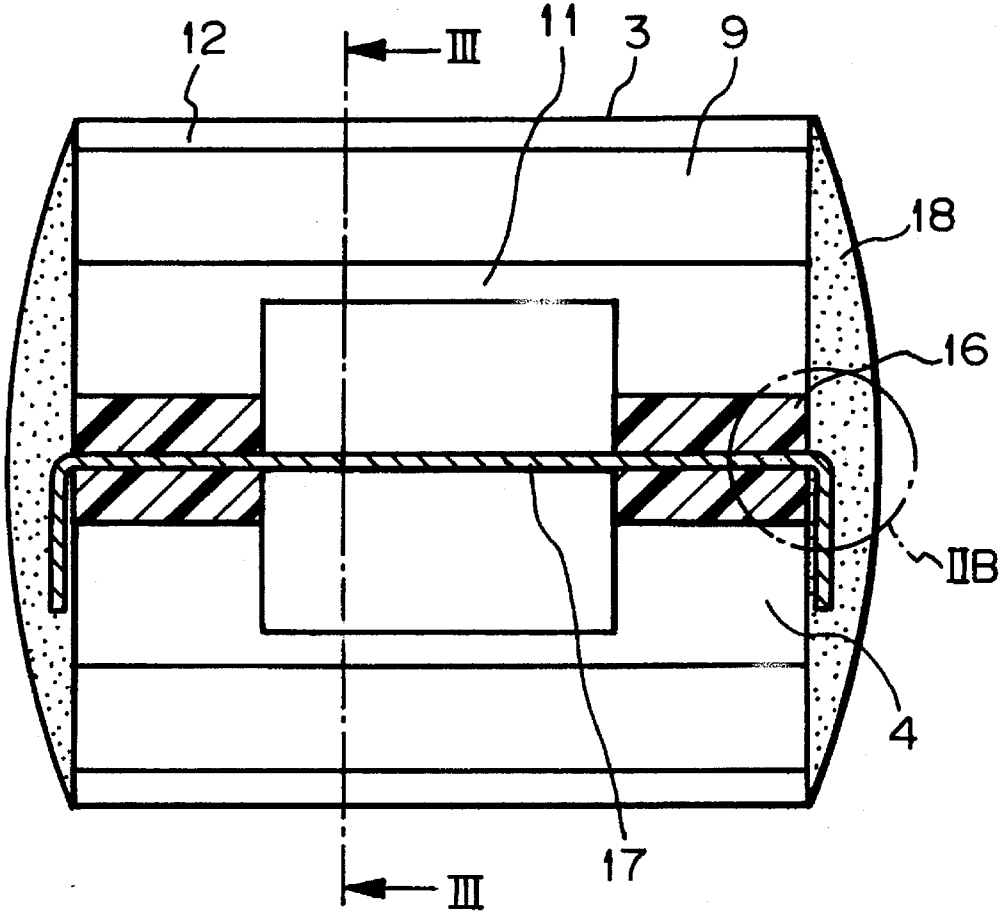
FIG. 2A is a sectional view taken along the line IIA—IIA in FIG. 1.
Figure 3:
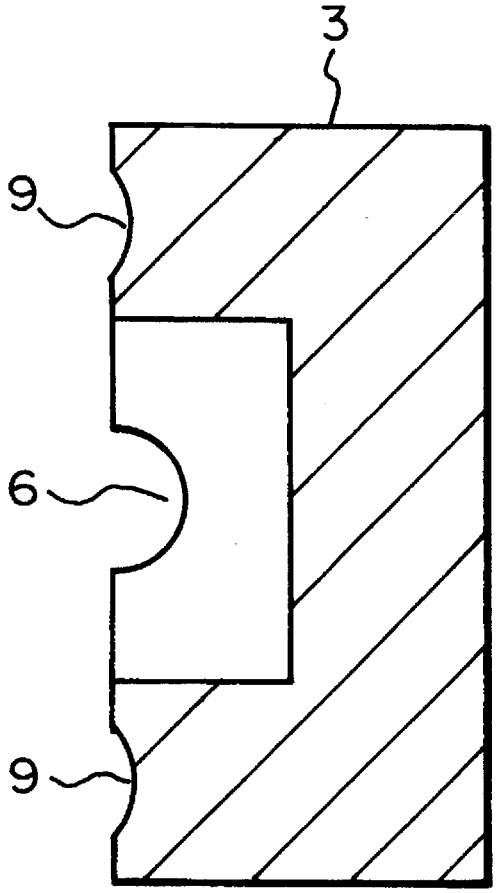
FIG. 3 fragmentary sectional view taken along the line III—III in FIG. 2A.

FIG. 1 is a perspective view partially broken to illustrate a microchip fuse which is an embodiment of the present invention. FIG. 2A is a sectional view taken along the line IIA—IIA in FIG. 1. FIG. 2B is an enlarged view of the portion designated by IIB in FIG. 2A. FIG. 3 is a fragmentary sectional view taken along the line III—III in FIG. 2. It is to be understood that the drawings are exaggerated or partially removed to facilitate understanding of the present invention and do not express exactly the actual configuration.

In FIG. 1, the casing 1 defines a cube of approximately 1.5 mm and is comprised of two members, an upper member 2 and a lower member 3. According to the present embodiment, the upper member 2 and the lower member 3 are made of electrically insulating material such as ceramics by a conventional molding method by use of a mold and provide identical box-like configurations. Semicircular grooves 6 are provided respectively at the same locations of the central portions of the edge portions 5 of a respective end surface members 4 of the upper member 2 and the lower member 3. At each of the identical positions at a edge portions 8 of a respective side members 7 of the upper member 2 and the lower member 3, there is provided a groove 9 having a fan-shaped sectional area extending between the opposite end surfaces of the upper member 2 and the lower member 3, spaced from the outer wall surface and the inner wall surface of the side member 7. When the upper member 2 and the lower member 3 are jointed together, a hollow portion 13 is formed at the side walls of the casing, being spaced from a first thin wall surface 11 from inner space 10 of the casing 1 and also spaced from a second wall surface 12 by means of both of the grooves 9 of the upper and lower members 2 and 3. It is also to be noted that the hollow portion 13 need not be of such a construction as to extend between the opposite end surfaces of the casing 1, but can be formed in a part of the side wall of the casing 1. It is further to be noted that the hollow portion 13 may be provided adjacent to the inner space 10 by way of a thin partition, and thus it may be disposed at any position, for example, as the lid portion or the like of the upper member 2 or the lower member 3.

By providing the hollow portion 13 adjacent to the interior space 10 by way of the first wall surface 11, the withstanding pressure of the casing 1 of the mating type of the upper member 2 and the lower member 3 against the pressure of the gas generated when a fusible element is melted to be severed may be reinforced. In other words, since the pressure of the gas which has been generated when the fusible element is melted to be severed is weakened due to breakage of the first wall surface 11, the first wall surface 11 and the hollow portion 13 serve as a means of damping the pressure. As a result, a higher threshold voltage where breakage will not occur can be attained for the casing 1 of identical dimension, whereby the breaking characteristics can be enhanced.

Furthermore, by filling the hollow portion 13 with the same electrically insulating material as the one used for an electrical insulator 16 to be explained hereinafter, the pressure of the gas generated when the fusible element is melted to be severed may further be damped, and it is also possible to prevent breakage of the casing.

As shown in FIG. 2B, there is applied on the outer end surfaces of the respective end surface members 4 of the upper member 2 and the lower member 3 conductive paste such silver (Ag) paste, silver-palladium (Ag—Pd) paste or the like, which is sintered at a temperature of about 850° C. to form a part of the electrode section 14 that is firmly adhered to the outer end surfaces of the respective end surface members 4. The thickness of such an electrode section as provided by sintering the silver-palladium paste is extremely thin in the order of 10–20 μm. It is to be noted that the application of such a paste may be effected by a dipping process. The sintering process may be performed under atmospheric conditions, such that expensive production facilities are not required and production is made easy. Furthermore, as it is seen from FIG. 2B, a metal 15 such as nickel is plated on the electrode section 14 comprised of sintered conductive paste. It is to be noted that such a plated metal may not be required depending on the purpose of the application.

According to the microchip fuse of the present embodiment, the electrode portion can be made extremely thin, on the order of 10–20 μm as compared to the conductive terminal of the metallic cap-like configuration according to the prior art which require a thickness on the order of 0.5–1.5 mm, whereby the creepage distance between the electrodes can be made longer and, as a consequence, the microchip fuse of the present embodiment can be further miniaturized as compared to conventional ones for the same creepage distance.

In order to attain quick acting characteristics, the fusible element has to be shorter. According to the microchip fuses of prior arts, which use cap-shaped conductive terminals and electrode sections, the length of the fusible element has to be at least twice the width of the circumferential portion of the conductive terminals so as to extend the fusible element between the electrode sections, resulting in a limitation in respect of shortening the length of the fusible element. In contrast to the above, in the present embodiment, since there exists no portion corresponding to the circumferential portions of the conductive terminals, the length of the fusible element can be shorter by the total widths of the circumferential portions of the both conductive terminals, and, as a consequence, the microchip fuse according to the present embodiment can provide more rapid breaking characteristics than that of a prior art.

In the grooves 6, there is filled electrical insulator 16 made for example of silicon resin, glass paste, inorganic adhesive, or the like. The insulator 16 is comprised of such a material so as not to be carbonized at an elevated temperature. A very thin wire-like fusible element 17 made for example of copper, silver or the like and having a diameter of 10–20 μm is extended in the interior space 10 of the casing 1 through the insulator 16 filled in one of the grooves 6 and extends outwardly from the casing 1 through the other groove 6. The jointed portions of the upper member 2 and the lower member 3 are adhesively attached to each other by adhesive, for example of epoxy resin or the like.

According to the microchip fuse of the present embodiment, the casing 1 is constructed from the upper member 2 and the lower member 3, which are to be jointed together in a mating manner such that it is easy to extend the fusible element 17, and thereby production can be carried out economically. In the case of a fine wire for use with a low rated current in particular, extension of such a wire can be remarkably easy compared to the extension through the conventional cylindrical casing. Furthermore, the quantity of the members can be reduced by making the upper member 2 and the lower member 3 of identical configuration and, as a consequence, the required facilities such as molds and the like, can be economically reduced, and the control/management of the components can be made easier.

Since the grooves 6 through which the fusible element 17 is extended are the portions where the withstanding pressure against the pressure of the gas to be generated when the fusible element is melted to be severed is relatively low, the insulators 16 filled in the grooves 6 serve as a means of damping the gas pressure and preventing breakage of the casing. Furthermore, the insulators 16 serve to enclose the melted metal when the fusible element 17 made of such metal is melted to be severed and, as a consequence, prevent the melted metal from being dispersed toward the electrode section 14, thereby maintaining the insulation characteristics of the fuse.

As shown in FIG. 2B, the end portion of the fusible element 17 projecting out of the insulators 16 is dipped in solder along the plated metal 15 of the electrode section 14 and soldered on the electrode section 14 as designated by the solder 18 by using solder pellets. While the end portion of the fusible element 17 is shown as oriented downwardly in FIG. 1, the end portion of the fusible element 17 is oriented laterally. This difference is for the sake of facilitating the explanation of the present invention and for easy understanding thereof. The direction of the fusible element 17 being laid on the electrode section 14 may take any direction.

The dimensions of the upper member 2 and the lower member 3 according to the present invention may be approximately as follows. The thickness of the end surface member 4 and the side member 7 and the depth of the depression respectively of the upper member 2 and the lower member 3 are approximately 0.4 mm, the radius of the groove is approximately 0.15 mm and the grooves 9 are spaced from the inner wall and the outer wall of the side member 7 by approximately 0.1 mm.

The microchip fuse according to the present embodiment, having such a construction as described above provides electrical characteristics as the rated AC voltage 125 V and the rated breaking current of 100 A at the rated current equal to or more than 1 A and is capable of being soldered to a printed board or the like by means of the so-called SMD (Surface Mounted Device) reflow.

Figure 4:
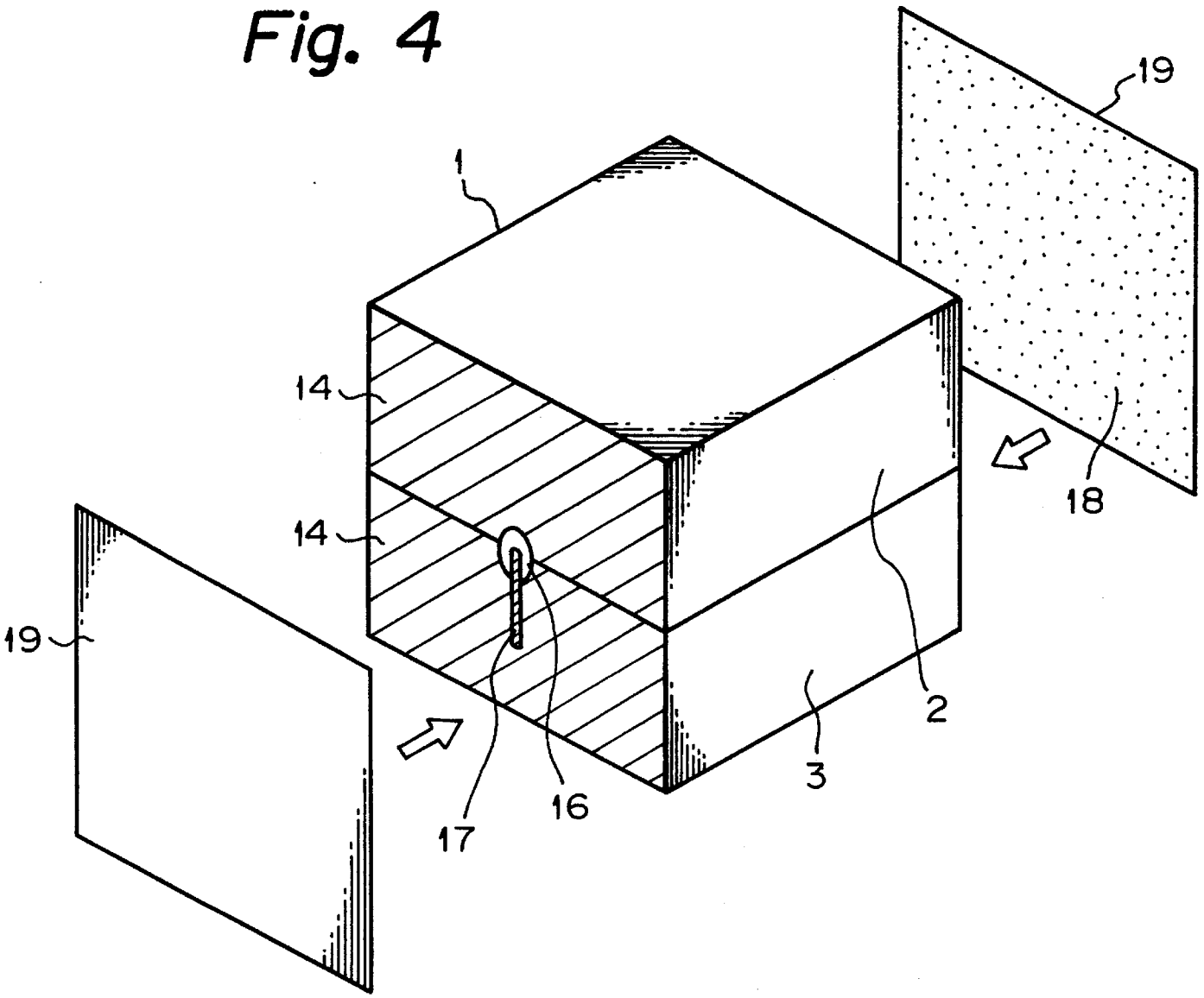
FIG. 4 is a partly exploded perspective view showing a microchip fuse according to another embodiment of the present invention.

FIG. 4 is an exploded perspective view of a part of a microchip fuse according to another embodiment of the present invention. In FIG. 4, identical numerals to those reference numerals used in FIG. 1 designate the same components and therefore, explanation thereof is not repeated here.

The difference of the microchip fuse shown in FIG. 4 from that of FIG. 1 is that nickel 15 is not plated on the electrode section 14 made of the silver-palladium paste which has been applied and sintered, and the metallic sheet 19 on which solder 18 has been plated in advance is soldered on the electrode section 14 made of the silver-palladium as one example. By this soldering, the end portion of the fusible element 17, the electrode section 14 of the silver-palladium and the metallic sheet 19 are electrically connected. For the thickness of the metallic sheet 19, a thickness on the order of 50 μm is suitable and the dimension of the metallic sheet 19 is substantially same as that of the end surface of the casing 1. Thus, by reinforcing the end surface of the casing 1 by means of the metallic sheet 19, the breakage strength of the end surface of the casing 1 against the pressure of the gas to be generated when the fusible element is melted to be severed can be increased. As a consequence, the breaking characteristics for the same dimension can be enhanced.

The present invention has been described in detail with reference to certain preferred embodiments thereof, but it will be understood that variations and modifications can be effected within the spirit and scope of the invention.

What is claimed is:

1. A microchip fuse, comprising:

an upper member comprising a pair of upper end surface members disposed opposite to each other with a given space therebetween and having respective opposite side portions, upper and lower edge portions and outer end surfaces, a pair of upper side members connecting said opposite side portions of said pair of upper end surface members and having upper and lower edge portions, and an upper lid member covering said upper edge portions of said pair of upper end surface members and said pair of upper side members, said upper member comprising an electrically insulating material;

a lower member comprising a pair of lower end surface members disposed opposite to each other with a given space therebetween and having respective opposite side portions, upper and lower edge portions and outer end surfaces, a pair of lower side members connecting said opposite side portions of said pair of lower end surface members and having upper and lower edge portions, and a lower lid member covering said lower edge portions of said pair of lower end surface members and said pair of lower side members, said lower member comprising an electrically insulating material;

electrode sections provided at said outer end surfaces of said pair of upper end surfaces members of said upper member and said pair of lower end surface members of said lower member by sintering so as to adhere electrically conductive paste thereto;

wherein said lower edge portions of said upper end surface members and said upper edge portions of said lower end surface members, and said lower edge portions of said upper side members and said upper edge portions of said lower side members, are joined such that said outer end surface of each one of said upper end surface members forms one planar surface together with one of said lower end surface members, and such that an enclosed space is defined in said upper member and said lower member; and a wire-like fusible element sandwiched between said lower edge portions of said upper end surface members and said upper edge portions of said lower end surface members and extending through said enclosed space, said fusible element having respective end portions connected to respective said electrode sections.

2. The microchip fuse as claimed in claim 1, wherein grooves are provided on at least one of said lower edge portions of said upper end surface members and said upper edge portions of said lower end surface members, said grooves being located opposite to each other respective opposite ones of said upper and lower end surface members, and said grooves having insulators therein for damping gas pressure generated when said fusible element is melted so as to be severed, said fusible element extending through said insulators.

3. The microchip fuse as claimed in claim 1, wherein at least one hollow portion is provided in at least one of said upper member and said lower member at a location adjacent to said enclosed space, said hollow portion being partitioned from said enclosed space by a partition wall.

4. The microchip fuse as claimed in claim 3, wherein said hollow portion is defined by a groove extending in a direction of extension of said fusible element on at least one of: said lower edge portion of one of said upper side members of said upper member; and said upper edge portion of one of said lower side members of said lower member.

5. The microchip fuse as claimed in claim 1, wherein metallic sheets having substantially the same size as that of said outer end surfaces are on said electrode sections and are mechanically fixed and electrically connected thereto by solder.

6. The microchip fuse as claimed in claim 1, wherein said electrode sections are plated.

7. The microchip fuse as claimed in claim 1, wherein said upper member and said lower member have an identical configuration.

* * * * *